US007168526B2

(12) United States Patent
De Sousa Marreiros Alves

(10) Patent No.: US 7,168,526 B2
(45) Date of Patent: Jan. 30, 2007

(54) PEOPLE AND CARGO TRANSPORTATION MACHINE

(75) Inventor: Vasco Alexandre De Sousa Marreiros Alves, Av. Almeida Carrapato, No. 30, Faro (PT) 8000-083

(73) Assignee: Vasco Alexandre De Sousa Marreiros Alves (PT)

( * ) Notice: Subject to any disclaimer, the term of this patent is extended or adjusted under 35 U.S.C. 154(b) by 65 days.

(21) Appl. No.: 10/989,429

(22) Filed: Nov. 17, 2004

(65) Prior Publication Data

US 2005/0236945 A1 Oct. 27, 2005

(30) Foreign Application Priority Data

Apr. 21, 2004 (PT) ..... 103110

(51) Int. Cl.
*B66B 9/06* (2006.01)
*B66B 9/00* (2006.01)
*B66B 7/04* (2006.01)

(52) U.S. Cl. ..... 187/245; 187/249; 187/409; 187/410

(58) Field of Classification Search ..... 187/249, 187/409, 410, 245; 104/127, 128, 129, 130.04; 198/468.1, 468.6, 550.11, 603
See application file for complete search history.

(56) References Cited

U.S. PATENT DOCUMENTS 561,223 A * 6/1896 Hamilton ..... 198/800
1,946,982 A * 2/1934 Mepeak ..... 187/264
2,507,887 A * 5/1950 Cheney ..... 187/201
3,319,932 A * 5/1967 Szczepanik ..... 254/9 C
3,328,019 A * 6/1967 Wilson ..... 267/186
3,517,775 A * 6/1970 Meyer ..... 187/245
3,610,160 A * 10/1971 Alimanestianu ..... 104/165
3,640,227 A * 2/1972 Webb ..... 104/130.04
3,743,044 A * 7/1973 Scheele ..... 180/24
3,831,714 A * 8/1974 Hedman et al. ..... 187/245
3,850,106 A * 11/1974 Krivec ..... 104/127
4,004,654 A * 1/1977 Hamy ..... 198/798
4,036,528 A * 7/1977 Langendorf ..... 298/17 S
4,854,805 A * 8/1989 Althoff et al. ..... 414/495
5,131,502 A * 7/1992 Sermi ..... 187/261
5,476,155 A * 12/1995 Nakatani et al. ..... 187/202
5,572,930 A * 11/1996 Hein ..... 104/128

(Continued)

FOREIGN PATENT DOCUMENTS

JP 02052888 A * 2/1990

(Continued)

*Primary Examiner*—Kathy Matecki
*Assistant Examiner*—Eric E. Pico
(74) *Attorney, Agent, or Firm*—Sughrue Mion, PLLC

(57) ABSTRACT

This patent relates to a machine for transporting people and cargo with three-dimensional and infinite movement along properly positioned rails. The main application is for transporting people between two points with different coordinates, for example between one floor of one building and another floor of another building, kilometres away.

It is composed essentially of:
a set of wheels (1 and 2) that roll on the rails (8 and 9);
a cabinet (7) where the people and cargo are transported;
a chassis that connects the wheels to a "T" beam (10);
this "T" beam (10) connects the chassis to the cabinet (7);
electrical engines that move the wheels.

The set of parts allows the cabinet to have a non-straight, three-dimensional and infinite movement, the cabinet always being in the vertical position.

4 Claims, 1 Drawing Sheet

U.S. PATENT DOCUMENTS 5,713,432 A * 2/1998 Richter et al. ..... 187/250
5,769,502 A * 6/1998 Bettini ..... 298/17 S
5,964,159 A * 10/1999 Hein ..... 104/128
5,971,493 A * 10/1999 Robert ..... 298/17 S

FOREIGN PATENT DOCUMENTS

JP 06156919 A * 6/1994

* cited by examiner

Fig. A
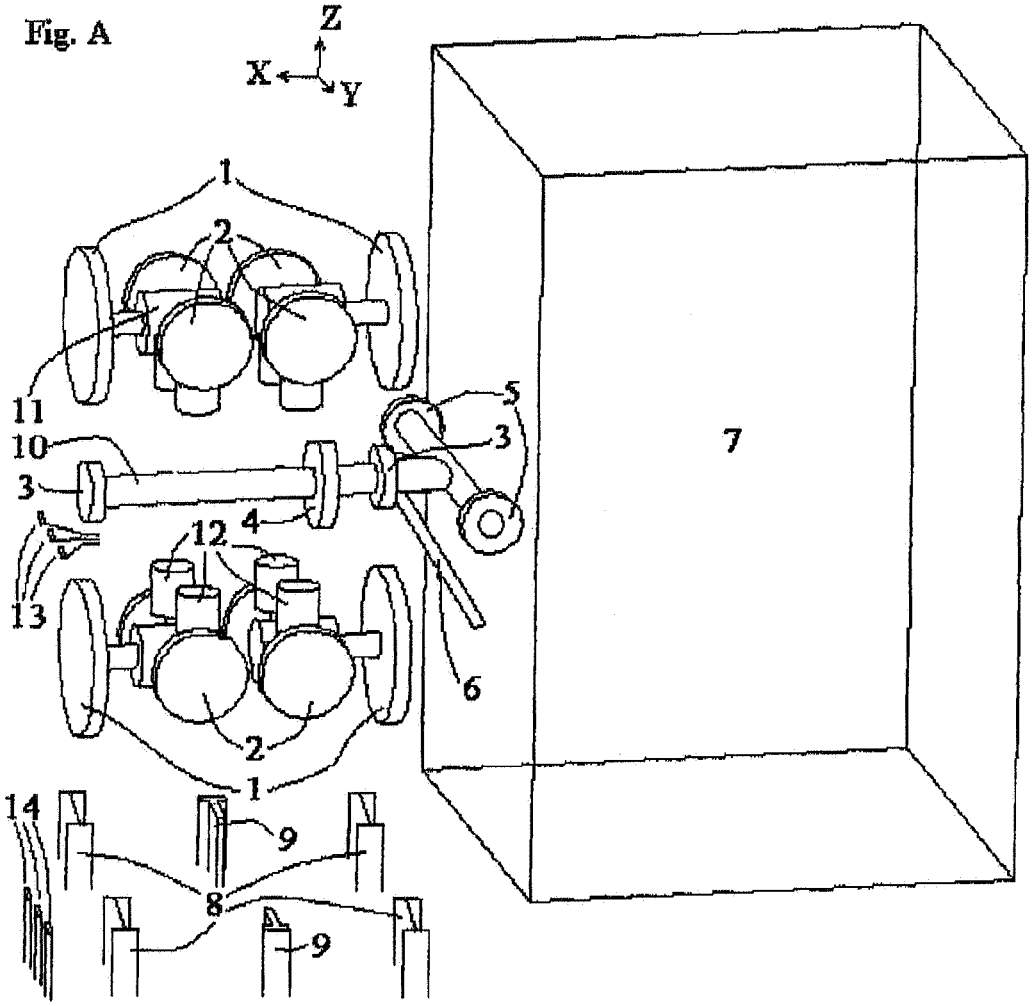
Fig. B
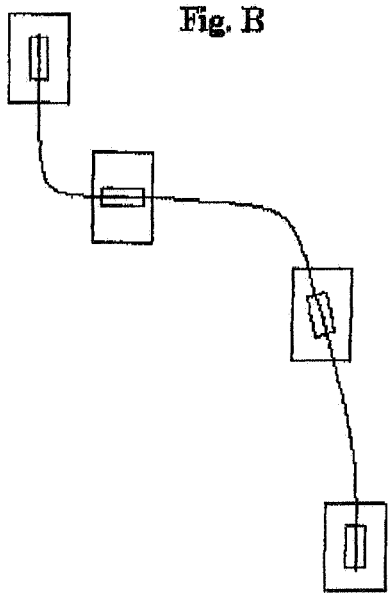
Fig. C
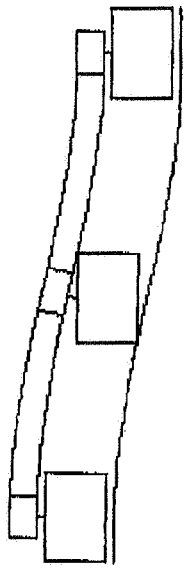

PEOPLE AND CARGO TRANSPORTATION MACHINE

STATE OF THE ART

There are today many ways of transporting people and cargo. These kinds of transport, divided into air, sea and land transport, use various types of machines, including the automobile and the train. The automobile can move on any flat ground but the train needs rails.

Although they can both have infinitely long three-dimensional trajectories, none of them can move in a vertical trajectory.

However, there is a machine that transports people (and also cargo) whose only possible movement is vertical; the elevator.

The elevator is built according to the cable traction model, with the propulsion machine exerting traction on the cables, pulling the cabinet on up movements and pulling the counter-weight on down movements, the hydraulic model, with a piston to raise the cabinet, or the rack rail model, where the engine (fixed to the cabinet) transmits rotating movement to a pinion which cooperates with the rack rail.

All these models, however, have a particularity: they move in straight and finite trajectories.

There is no transportation machine on the market today that has a non-straight movement, with an approximately vertical trajectory and an infinitely possible distance to cover.

The machine on the market whose characteristics most closely resemble these ones is the rack rail elevator, but it is always built to operate on straight and finite rack rails (vertical or inclined).

The cabinets cannot rotate: they are fixed to the engine and maintain the same angle of inclination. This is why the trajectories are always straight.

Furthermore, the engines are fed through a cable that is connected to a fixed point (to the electrical switch somewhere on the trajectory), which means that the trajectory of the elevator has to be finite, because at some point the cable "ends".

GENERAL DESCRIPTION

The machine for which a patent is requested is a machine for transporting people and cargo that moves on rails which, according to their layout, allow the machine to have a three-dimensional and infinite movement.

The main application is to transport people and cargo between two points at different coordinates on the three axes: this machine can transport people and cargo from one floor of one building to another floor of another building, kilometres away, without having to follow a straight trajectory.

This machine can pick up a person on the ground floor of one building, move down to the basement, then circulate through a network of tunnels until it reaches the basement of another building (which, in theory, can be an infinite distance away) and then go up to any floor of that building (which, in theory, can be at an infinite height).

All it needs is the appropriate location of the rails (just like trains can reach a point, in theory, at an infinite distance: all they need is the appropriate location of the rails; however, unlike this machine, trains cannot have a vertical trajectory, whereas this machine can).

BRIEF DESCRIPTION OF THE DRAWINGS

FIG. A—perspective view from the front side;

FIG. B—Left-hand side elevation;

FIG. C—Main elevation.

TECHNICAL DESCRIPTION (The numbers refer to FIG. A, which shows this machine in a vertical movement).

The machine is composed essentially of two large objects: on one hand the cabinet (7), where the people and cargo are transported (which does not possess any special characteristic to be mentioned in the claims), and on the other hand the body, where the wheels (which mechanically connect the machine to the rails), the hydraulic system and the engines are essentially situated.

The description will always make reference to the numbering system used for the figure.

The machine moves approximately on the Z axis with the body moving along a set of rails (8 and 9), On which the wheels (1 and 2) roll: the wheels 1, with rotating direction on the x axis, roll on the rails 8, which are located on both sides of the wheels and, according to the moving inclination of the cabinet, will roll on only one of the rails. These wheels and rails are smooth.

The wheels 1, on other hand, can also rotate at a small angle on the Y axis, in order to adapt to the rails when they bend to form a curve on the XZ plane.

The wheels 2, with rotating direction on the Y axis, roll on the rails 9, each opposite pair of wheels acting on the same rail. These are pinions and rack rails. These rack rails split onto two racked surfaces on bends, each surface having a different distance between teeth to adapt to each wheel (which have a different curve radius).

The wheels are propelled by electrical engines.

All these wheels are mechanically connected on the chassis (not shown in the drawings), a metallic structure with an appropriate form for this purpose.

Also mechanically connected to the chassis are two bearings (3), which support in their interior the arm (10), an element composed of two beams welded in a "T" shape.

By virtue of the bearings (3), the arm can rotate on the X axis.

At the other two ends of the arm (10) there are two bearings (5) that are fixed to the cabinet (7) on their outside surface.

Thanks to the bearings (5), the cabinet can rotate on the Y axis.

At a middle point of the arm there is a pinion (4), on which an engine fixed to the chassis acts, this engine being responsible for rotating the arm on the X axis (and, as a consequence, the cabinet).

At another middle point of the arm there is a piston (6), the other end of which is fixed to the cabinet, this piston being responsible for rotating the cabinet on the Y axis.

All the engines are electrical, being fed by electrical current obtained by electrical brushes which slide on electrical rails parallel to the rails.

The total set of parts allows the cabinet to have a three-dimensional movement, allowing soft curves to the front and back (FIG. C) and curves at any angle to the sides, allowing trajectories of any angle, from 0° trajectories, vertical movement to 90° trajectories, horizontal movement (observing the cabinet from the front—FIG. B), the cabinet always being in the vertical position.

The invention claimed is:

1. A machine for transporting people and cargo with tri-dimensional movement circulating on rails, comprising:

a cabinet (7) where people and cargo are transported, a chassis that mechanically connects a set of smooth wheels (1) that roll on smooth rails (8), a set of pinions (2) that roll on rack rails (9), being said pinions propelled by electrical motors (12), a first set of two bearings (3) that support an element (10), composed of two beams welded together at a middle point of one of said two beams, allowing said element to rotate about an X axis by a rotation of pinions (4) fixed to said element at a point between said first set of two bearings (3), a second set of two bearings (5) fixed on an inside of the second set of two bearings (5) to ends of the element (10) and on an outside of the second set of two bearings (5) to the cabinet (7), allowing the cabinet to rotate about a Y axis through an extensible beam (6), fixed at one end to the element (10) and at the other end to the cabinet (7), wherein some of the wheels are propelled by electrical engines, fed by electrical current obtained by electrical brushes (13) that slide on electrical rails (14) positioned parallel to the rails (8) and (9), thus permitting, the movement of the cabinet along a non-straight tri-dimensional and continuous trajectory, always maintaining the cabinet in the vertical position.

2. The machine according to claim 1, characterised by using several of said machines located one above the other within same vertical shaft, multiplying the passenger and cargo transport capacity of one shaft compared to the capacity of the elevator system.

3. The machine according to claim 1, wherein said wheels are propelled by electrical engines (11).

4. The machine according to claim 1, wherein said pinions are propelled by electrical engines (12).

* * * * *